United States Patent [19]

Guillen

[11] 4,040,543

[45] Aug. 9, 1977

[54] ADJUSTABLE AEROSOL CAN HOLDER

[76] Inventor: Rafael Guillen, 2826 18th St., National City, Calif. 92050

[21] Appl. No.: 639,791

[22] Filed: Dec. 11, 1975

[51] Int. Cl.[2] ..... A47G 19/14

[52] U.S. Cl. ..... 222/473; 224/45 C; 294/29; 239/375

[58] Field of Search ..... 224/45 C; 294/29, 28, 294/32, 27 R; 222/174, 470, 472, 473, 474, 323, 402.15; 239/375

[56] References Cited

U.S. PATENT DOCUMENTS

| | | | |
|---|---|---|---|
| 299,096 | 5/1884 | Winter | 222/174 |
| 1,960,507 | 5/1934 | Platt | 294/28 |
| 2,580,824 | 1/1952 | Oliver et al. | 294/29 |
| 2,808,285 | 10/1957 | Robuck | 294/29 |
| 2,868,421 | 1/1959 | Schott | 222/473 |
| 3,045,878 | 7/1962 | Blanford et al. | 222/473 |
| 3,659,791 | 5/1972 | Clark | 222/474 |
| 3,856,209 | 12/1974 | Hickson | 222/473 |

*Primary Examiner*—Robert J. Spar
*Assistant Examiner*—Kenneth Noland
*Attorney, Agent, or Firm*—Ralph S. Branscomb

[57] ABSTRACT

An adjustable aerosol can holder which securely engages a can by its upper rim and bottom and has a trigger-operated actuator for depressing the firing head of the can to fire same.

1 Claim, 3 Drawing Figures

ADJUSTABLE AEROSOL CAN HOLDER

BACKGROUND OF THE INVENTION

Although the use of aerosol cans without additional accessories presents no problem under ordinary circumstances, in instances requiring the extensive use of aerosols over a long period of time, the operator will experience finger fatigue. Temporary maintenance involving spray painting aboard ships at sea provides an example of a situation in which fatigue becomes a problem.

Aerosol can holders have been developed to alleviate the problem but most of them engage the can with a fork or yolk which straddles an annular boss provided on most cans, and thus subjects the can to the possibility of being knocked free of the holder. There is a need for a lightweight and inexpensively manufactured can holder which securely grips a can in such a way that accidental separation of the can from the holder is not possible and yet is adjustable to accommodate different can sizes.

SUMMARY OF THE INVENTION

The invention fulfills the abovementioned need and comprises a holder having a hooked element which securely engages the upper rim of an aerosol can and a cupped bottom clamping member which is pivotable to securely seat the bottom of the can therein, the hooked member and clamp being attached to a handle to which is also mounted a spring-loaded, trigger-operated actuator having a set screw in the end thereof to depress the firing head of the can.

DETAILED DESCRIPTION OF THE PREFERRED EMBODIMENT

Figure 1:
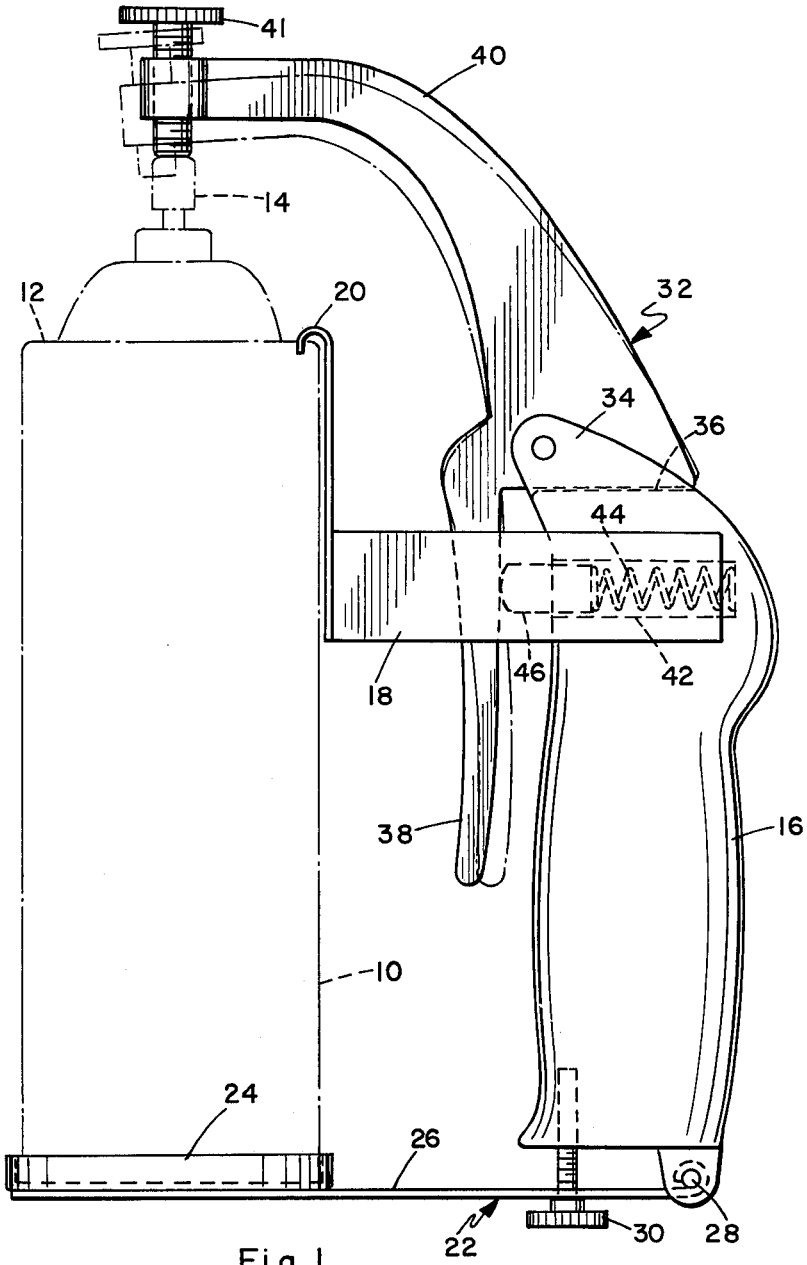
FIG. 1 is a side elevation view of the spray can holder with a typical can indicated in broken line.
Figure 2:
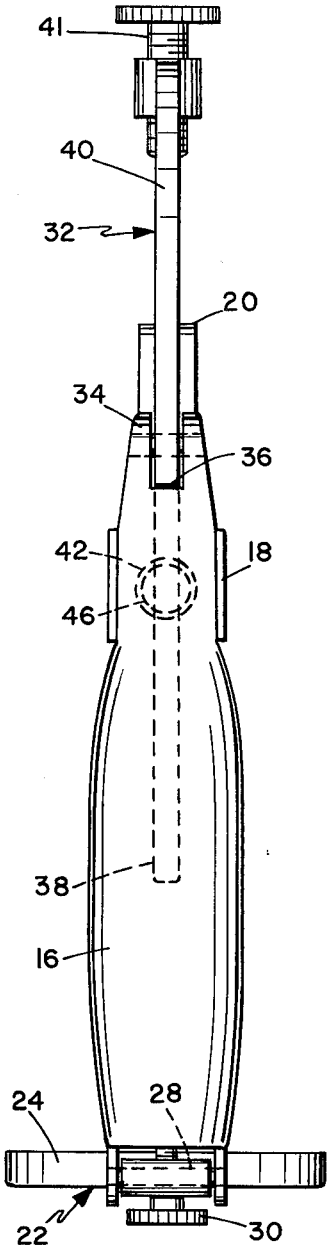
FIG. 2 is a view as taken from the right hand side of FIG. 1.
Figure 3:
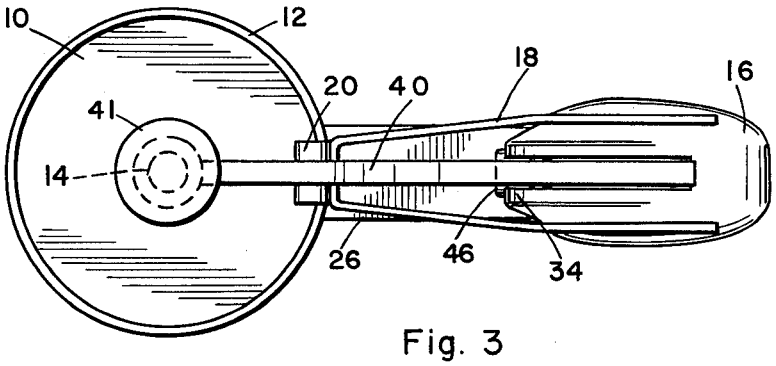
FIG. 3 is a top plan view of the holder.

A typical aerosol can is indicated at 10 having a cylindrical body and an upper rim 12, the discharging of the pressurized contents being accomplished by depressing the firing head 14. The holder includes a somewhat form-fitted handle 16 having a forked bracket 18 mounted to the opposite sides of an upper portion thereof, this bracket carrying a hooked member 20 which securely engages the rim 12 of the can.

A clamp element 22 having a cupped portion 24 is pivotally mounted by means of connecting arm 26 and axle pin 28 to the bottom of the handle, and as can be seen in FIG. 1, a screw 30 which passes through the connecting arm 26 into the bottom of the handle releasably holds the cupped portion 24 of the pivotal clamp element in can-engaging position such that the can is compressed between the bottom bracket and the hook 20. It can thus be seen that with the lower end of the can seated in the cup 24, and the upper rim engaged by the hook 20, it is virtually impossible for the cannister to become knocked or jarred loose from the holder in use and that release of the can could only be effected by deliberately withdrawing the retaining screw 30.

Firing of the can is effected by an actuator 32 which is mounted in journalled relationship between two channel-forming members 34, the bottom 36 of the channel thus formed acting as a stop to limit the rotation of the actuator in the clock-wise direction taken from FIG. 1. The actuator includes a trigger 38 depending therefrom near the front side of the handle and it can be seen that as the actuator is rotated by squeezing the trigger, an extension arm 40 which projects into the proximity of the firing head 14 is moved downwardly, as shown in phantom in FIG. 1, such that a set screw 41 threaded through the end of the extension arm depresses the firing head and dispenses the contents of the can.

An upper portion of the handle is bored from the front at 42 and in this bore is disposed a coil spring 44, and a retainer plug 46 is slidably seated in this bore and outwardly biases the trigger of the actuator 32 such that the can is not in its dispensing mode until the trigger is activated to overcome the spring bias. Although the handle and trigger arrangement permits comfortable operation of the can for extended time periods, it is also possible to set the can in its dispensing mode by adjusting the head depressor screw 41 downwardly so that the trigger need not be operated at all. It should be noted that this set screw 41 also permits the holder to be used on cans having varying spacing between the upper rim 12 and the top of the firing head.

Clearly some modification of the structure as described could be effected while retaining the basic advantages of the holder, including the positive clamping action achieved by use of the clamp bracket 22 and the upper hook 20, and the flexibility achieved by incorporating a depressor screw 21 in the end of the extension arm of the actuator.

I claim:

1. A holder and dispenser for a cylindrical pressurized cannister having an upper rim and a firing head comprising:

a. an elongated handle;

b. a hooked member mounted to said handle for engaging the upper rim of a pressurized cannister;

c. a clamp element pivotally mounted on said handle for engaging the bottom of said cannister and a set screw passing through said clamp element and threadably engaging said handle to force said clamp element towards said hooked member to engage a pressurized cannister therebetween and such that the spacing between said clamping element and hooked member is variable;

d. an actuator pivotally mounted to said handle and having an arm extending into adjacency with said firing head for firing same and a trigger element extending along said handle in spaced relation thereto; and e. a variably extendible firing head depressor mounted in the distal end of said actuator arm to fire said cannister upon moving said actuator, whereby a plurality of cannisters of different rim-to-firing head spacing may be accommodated and the cannister may be temporarily set in its dispensing mode.

* * * * *